US006899142B2

(12) United States Patent
Birzele

(10) Patent No.: US 6,899,142 B2
(45) Date of Patent: May 31, 2005

(54) FABRIC BELT FOR A CORRUGATED BOARD GLUING MACHINE

(75) Inventor: Armin Birzele, Ulm (DE)

(73) Assignee: Mühlen Sohn GmbH & Co., Blaustein (DE)

( * ) Notice: Subject to any disclaimer, the term of this patent is extended or adjusted under 35 U.S.C. 154(b) by 0 days.

(21) Appl. No.: 10/707,752

(22) Filed: Jan. 9, 2004

(65) Prior Publication Data

US 2004/0118474 A1 Jun. 24, 2004

Related U.S. Application Data

(63) Continuation of application No. PCT/EP01/08958, filed on Aug. 2, 2001, now abandoned.

(51) Int. Cl.[7] ..... D21F 1/10

(52) U.S. Cl. ..... 139/383 A; 162/358.2; 162/348; 424/270

(58) Field of Search ..... 139/383 A; 162/358.2, 162/348; 424/266, 267, 268, 270

(56) References Cited

U.S. PATENT DOCUMENTS

| | | | | |
|---|---|---|---|---|
| 3,368,933 A | | 2/1968 | Wicker | 156/498 |
| 4,274,448 A | | 6/1981 | Westhead | 139/383 |
| 4,308,897 A | | 1/1982 | Westhead | 139/383 |
| 4,403,632 A | | 9/1983 | Romanski et al. | 139/383 |
| 5,087,327 A | * | 2/1992 | Hood | 162/358.2 |
| 5,164,249 A | | 11/1992 | Tyler et al. | 428/225 |
| 5,407,737 A | * | 4/1995 | Halterbeck et al. | 442/195 |
| 5,597,450 A | * | 1/1997 | Baker et al. | 162/348 |
| 5,785,621 A | * | 7/1998 | Birzele | 474/267 |
| 6,179,965 B1 | * | 1/2001 | Cunnane et al. | 162/358.2 |
| 6,308,878 B1 | | 10/2001 | Stahlecker | 226/170 |

FOREIGN PATENT DOCUMENTS

| | | |
|---|---|---|
| DE | 40 40 861 | 7/1992 |
| GB | 451 752 | 7/1937 |

* cited by examiner

*Primary Examiner*—John J. Calvert
*Assistant Examiner*—Robert H. Muromoto, Jr.
(74) *Attorney, Agent, or Firm*—Gudrun E. Huckett

(57) ABSTRACT

A fabric belt for a corrugated cardboard gluing machine has a first fabric layer for receiving tensile forces. The first fabric layer is made of warp threads and weft threads. A second fabric layer covers the first fabric layer and is made of warp threads and weft threads. The second fabric layer forms an upper paper side of the fabric belt. The first and second fabric layers are interwoven by binding threads. The fabric belt has drainage channels penetrating the fabric belt at least partially, wherein the drainage channels remove moisture from the second fabric layer and the upper paper side.

16 Claims, 4 Drawing Sheets

FABRIC BELT FOR A CORRUGATED BOARD GLUING MACHINE

CROSS REFERENCE TO RELATED APPLICATIONS

This application is a continuation of International Application PCT/EP01/08958 with an international filing date of Aug. 2, 2001, not published in English under PCT Article 21(2), and now abandoned.

BACKGROUND OF INVENTION

1. Field of the Invention

The invention relates to a fabric belt for a corrugated cardboard gluing machine. The fabric belt comprises a first fabric layer, comprised of warp threads and weft threads, for receiving tensile forces and an additional upper fabric layer covering the first fabric layer and comprised of warp threads and weft threads. The upper fabric layer forms the upper paper side. The fabric layers are interwoven by means of binding threads.

2. Description of the Related Art

WO 96/07788 discloses a woven fabric belt for a corrugated cardboard gluing machine that ensures excellent dewatering of the material placed on top over a long period of operation with a high-quality standard. As a result of growing requirements, it must be ensured that the belt has a sufficiently high mechanical strength. This leads to multi-layer fabric structures that reduce the permeability of the belt in a disadvantageous way.

SUMMARY OF INVENTION

It is an object of the present invention to configure a belt for a corrugated cardboard gluing machines such that, despite its multi-layer structure and high mechanical strength, a high permeability of the belt for fast dessication of the material placed on top is achieved.

In accordance with the present invention, this is achieved in that the belt has drainage channels penetrating the belt at least partially. Vis the drainage channels, vapor or moisture can be removed from the upper fabric layer and from the paper side.

By means of the drainage channels, the vapor (moisture) is removed from the paper side to the opposite side of the belt.

The drainage channels can be formed as openings in the woven structure of the fabric. However, it can also be expedient to from the drainage channels by providing different thread thicknesses and/or thread structures. The drainage channels can be formed by the thread gaps that are formed by omitting or adding threads.

In particular, the drainage channels can be formed by individual threads of a fabric layer, wherein the individual treads are comprised of a material that forms cavities after a short period of time.

Such cavity-forming thread material is configured such that for the technical weaving process it can be processed like a conventional single thread and serves within the fabric structure as a three-dimensional spacer element. After a certain operating time of the belt, for example, after the conventional break-in time of the belt, the thread material has formed a cavity that acts within the woven fabric structure as a drainage channel.

The cavity-forming thread material can be a thread material having a high proportion of starch; preferably, the cavity-forming threads are comprised completely of starch. Thread material of starch can be processed in the dry state like a conventional thread. However, as soon as such a cavity-forming thread comprised of starch comes into contact with water, the starch will dissolve and will be washed out with the water. The material of the cavity-forming thread is thus dissolved away from the woven fabric structure so that a gap is formed that extends as a drainage channel across the length and/or width and/or height of the belt.

Expediently, the cavity-forming thread material can also be a thread material comprised of cavity-containing (hollow) fibers that have only minimal wear resistance. After the break-in time of the belt, the cavity-containing fibers will be worn and break open so that the cavity, now open to the exterior, forms a drainage channel. Such hollow fibers or cavity-containing fibers employ in addition capillary action for removal of liquids from the face of the paperPreferably, the drainage channels open at the underside of the belt. In a particular configuration, the drainage channels are configured as cavities penetrating the belt. The configuration of the fabric structure provided during weaving allows for providing a constructively precise position of the drainage channels and a desired number of drainage channels per unit of surface area.

Advantageously, the belt is made of plastic material threads comprised of a mixture of approximately 65% polyester and approximately 35% viscose.

Expediently, thread material that has a high temperature resistance, in particular, material in the form of para aramids or Kevlar®(registered trademark of the DuPont Corp.), is woven into the belt; this thread material provides at the same time wear protection. In particular, the temperature-resistant thread material is woven into the belt within a narrow area along the longitudinal edges, i.e., in the direction of the warp threads. However, it can be advantageous to weave the temperature-resistant thread material, in particular, in the form of warp threads, into the upper and/or lower fabric layer within a wide edge area up to the point of completely covering the surface area.

DETAILED DESCRIPTION

Figure 1:
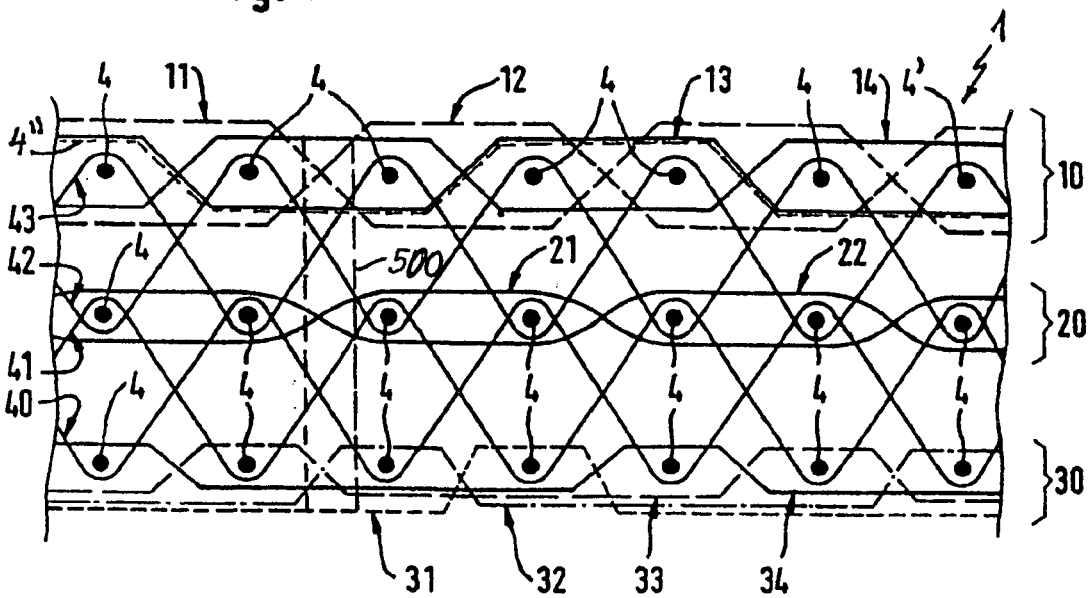
FIG. 1 shows a first embodiment of a woven belt according to the present invention in longitudinal section.

FIG. 1 shows a first embodiment of a belt 1 according to the present invention. The belt 1 that is preferably manufactured of plastic (synthetic) material threads is comprised of an upper fabric layer 10, a central or middle fabric layer 20 for receiving or absorbing tensile forces, and a lower fabric layer 30. The side of the upper fabric layer 10 facing away from the fabric layer 20 that is arranged centrally and absorbs the tensile forces forms the paper side (side facing the paper) of the fabric belts 1.

In the fabric layers 10, 20, 30 the weft threads 4 extend transversely to the longitudinal direction 5 (FIG. 2) of the belt 1.

In the upper or top fabric layer 10 a repeating set of four warp threads 11, 12, 13, and 14 (FIGS. 1 and 2) are provided; they extend displaced or staggered relative to one another. These warp threads cross, inwardly toward the central fabric layer 20 as well as outwardly toward the paper side, at least two weft threads 4 (FIG. 1), respectively.

The central fabric layer 20 receiving the tensile forces has two warp threads 21, 22 that are displaced or staggered relative to one another and cross two weft threads 4, respectively.

The lower fabric layer 30 is comprised of four warp threads 31, 32, 33, 34 that are displaced or staggered relative to one another and cross inwardly, toward the central fabric layer 20, only a single weft thread 4 and outwardly at least three weft threads 4.

The three fabric layers 10, 20, 30 are interwoven with one another by means of binding threads 40, 41, 42, 43. The binding threads are divided into two thread groups. The binding fibers 42, 43 form a first thread group and are displaced relative to one another; they connect the upper fabric layer 10 and the central fabric layer 20 to one another. The binding threads 42, 43 are alternatingly guided across one warp thread 4 in the upper fabric layer 10 and one warp thread 4 in the lower fabric layer 20. Similarly, a second thread group is formed of the binding threads 40 and 41, and the threads 40, 41 connect the lower fabric layer 32 and the central fabric layer 20.

Figure 2:
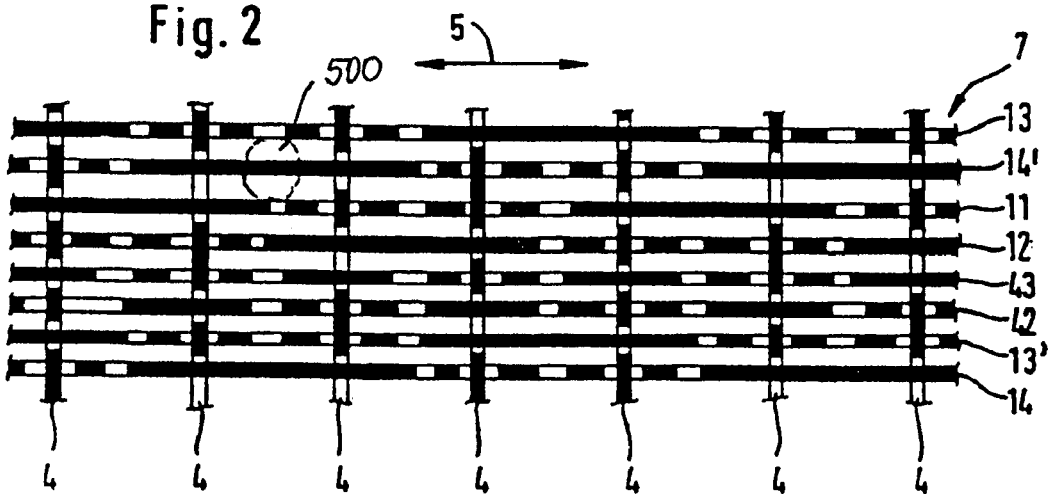
FIG. 2 shows a partial plan view onto the upper fabric layer forming the side facing the paper (paper side) of the belt of FIG. 1.
Figure 3:
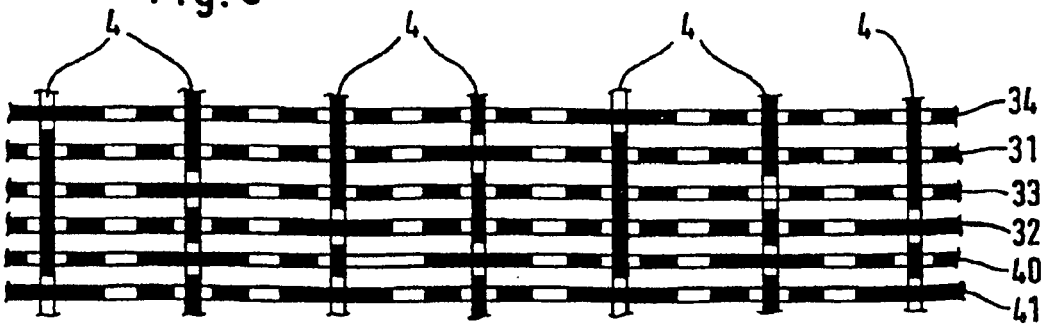
FIG. 3 is a plan view onto the exterior side of the lower fabric layer of the belt of FIG. 1.
Figure 4:
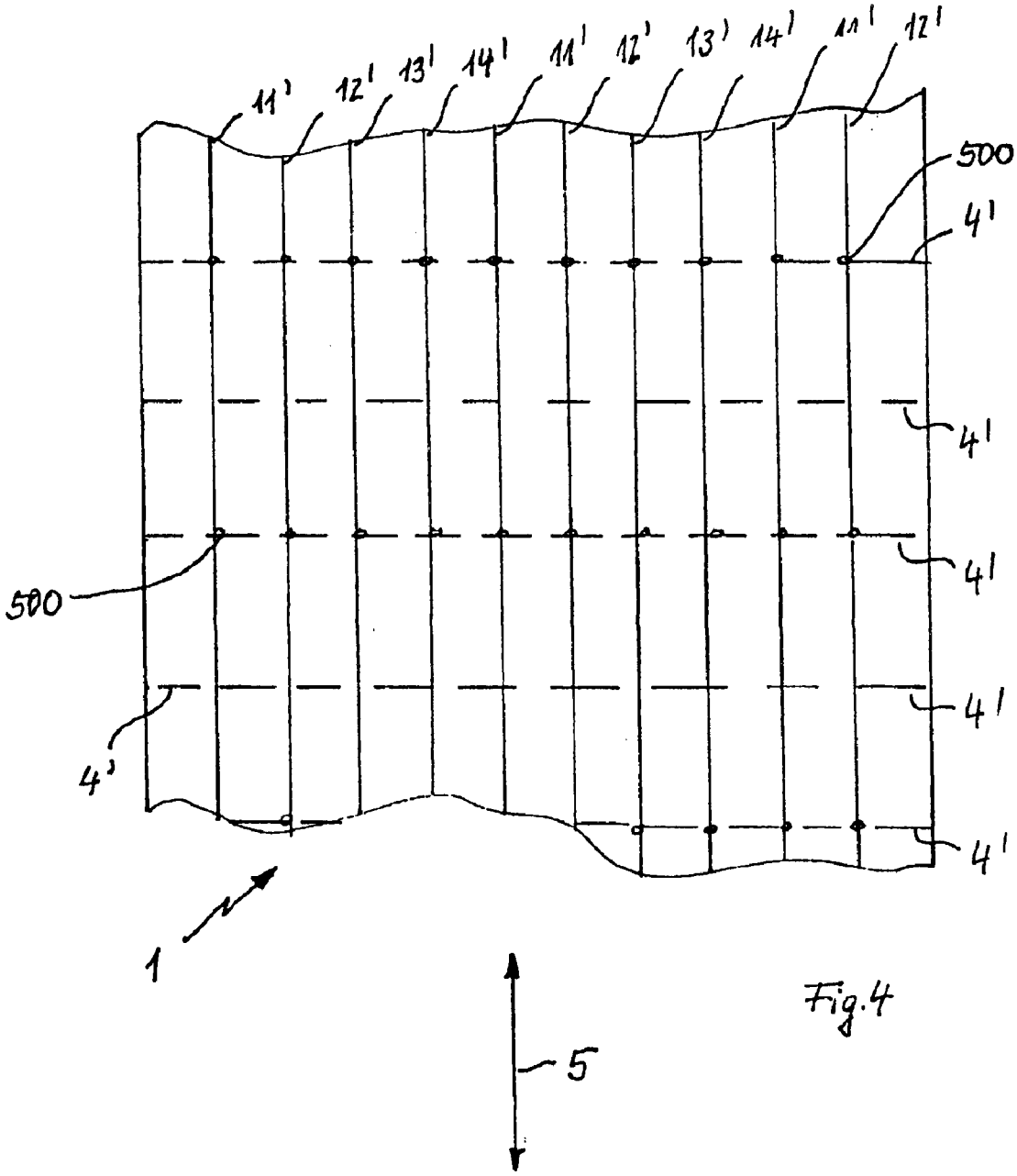
FIG. 4 is a schematic plan view onto the paper side of the belt according to FIG. 1.

As illustrated in FIG. 4 in connection with FIGS. 1 to 3, in the illustrated embodiment at least one warp thread 14' extending in the longitudinal direction 5 of the belt 1 is provided in the upper fabric layer 10 of the belt 1; the thread 14' is comprised of a cavity-forming thread material, i.e., a thread material that is different from the warp threads 11, 12, 13 and 14 provided across the remaining portion of the upper fabric layer 10. The individual warp threads 11', 12', 13', 14' of the paper-forming fabric layer 10 are comprised of cavity-forming thread material that communicates with drainage channels 500. Each drainage channel 500 is preferably provided as a cavity that is mechanically woven into the fabric and extends from the paper side away in the direction toward the underside of the belt. Preferably, the cavity 500 opens at the underside of the belt that is facing away from the paper side and is formed in particular as a cavity penetrating the belt. In this way, as illustrated in FIG. 4, the cavities 500 are designed like a drain through which vapor or moisture can be guided away from the paper side of the upper fabric layer 10 through the belt 1.

The weft threads 4' and the warp threads 11', 12', 13', 14' advantageously cross the drainage channels 500 that are mechanically woven into the belt 1. In particular, the drainage channels 500 are arranged at the crossing points of the weft threads 4' and the warp threads 11', 12', 13', 14'.

The cavity-forming thread material is, for example, a thread material having a high starch content. Preferably, the thread material is comprised completely of starch. This has the result that, in the dry state, the cavity-forming threads consisting of starch or containing a high percentage of starch can be processed like regular threads. In the fabric structure, they form stand-ins that dissolve upon contact with liquid, in particular, water. The voids that result after dissolution and washing out of the starch within the fabric provide drainage channels, drainage grooves or the like that open into the drainage channels 500 mechanically woven into the material. In this way, in the area between the drainage channels 500 a kind of drainage grid is formed which supplies the liquid that is present directly to the mechanically woven drainage channel 500 and in this way ensures a quick dewatering action of the material placed onto the fabric belt. In this connection, the warp threads made of cavity-forming thread material, after a certain operating time has elapsed, form longitudinal channels in the longitudinal direction and weft threads 4' made of such a cavity-forming thread material form transverse channels. Since the longitudinal channels and the transverse channels cross one another because of the fabric structure (warp threads, weft threads), the transverse channels and the longitudinal channels are connected to one another in order to provide flow communication. A fast drainage of the liquid is provided in this way.

The cavity-forming thread material can also be in the form of hollow fibers (cavity-containing fibers). After elapse of a certain operating time, as a result of wear that occurs on the belt, the hollow fibers will open so that their inner cavities themselves will form drainage channels that extend in the longitudinal direction of the warp and weft threads.

In order to continue the drainage structure in the direction of depth, there are also warp and weft threads of cavity-forming thread material provided in the additional fabric layers 20 and 30. It is also possible to provide individual binding threads that are made of cavity-forming thread material so that drainage channels can be formed in the fabric structure that extend from one fabric layer 10, 20 to another fabric layer 20, 30.

It can be expedient for the purpose of preventing a disturbance of the woven structure to provide a cavity-forming thread material as an auxiliary thread 4" added to a warp thread, a weft thread, or a binding thread. The number of warp threads, weft threads, and binding threads that determine the fabric structure remains unchanged; a thread made of cavity-forming thread material is added as an auxiliary thread 4" to a warp thread and/or a weft thread and/or a binding thread and, as a stand-in, forms later on the desired drainage channels.

Cavity-forming threads can be expediently provided in the fabric layer 10 forming the paper side, wherein, for enhancing the dewatering action and for forming the drainage channels 500, the other fabric layers 20, 30 can also contain cavity-forming threads.

Figure 5:
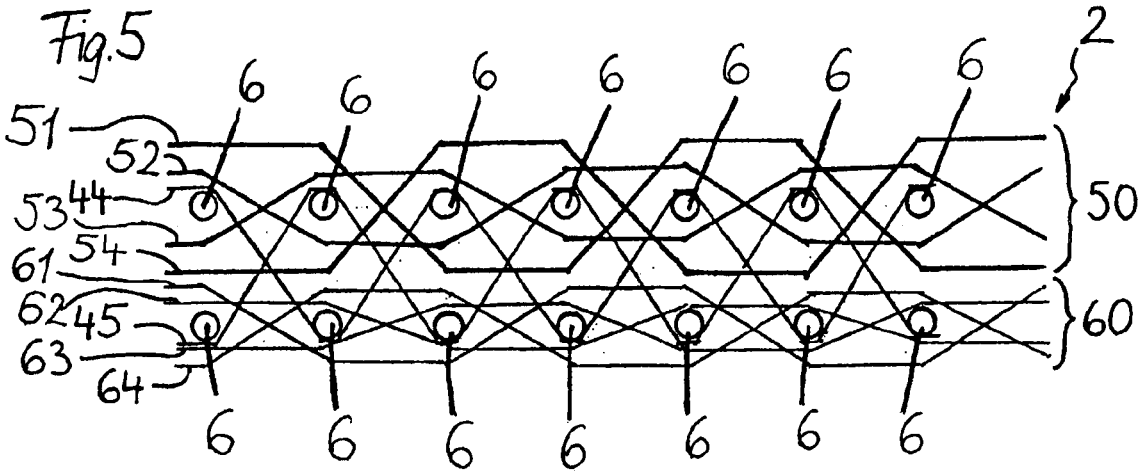
FIG. 5 is a schematic illustration of a second embodiment of a woven belt according to the present invention in longitudinal section.

FIG. 5 shows a schematic illustration of a second fabric belt 2 in longitudinal section. The belt 2 is comprised of an upper fabric layer 50 and a lower fabric layer 60. The upper fabric layer 50 forming the paper side has a repeating set of four warp threads 51, 52, 53, and 54 that are displaced (staggered) relative to one another, and the lower fabric layer 60 has a repeating set of four warp threads 61, 62, 63, and 64 that are displaced or staggered relative to one another. The weft threads 6 extend transversely to the longitudinal direction 7. The warp threads cross two weft threads 6, respectively. The upper fabric layer 50 and the lower fabric layer 60 are connected to one another by binding threads 44, 45 wherein the binding threads are displaced or staggered relative to one another and cross one weft thread 6, respectively.

Figure 6:
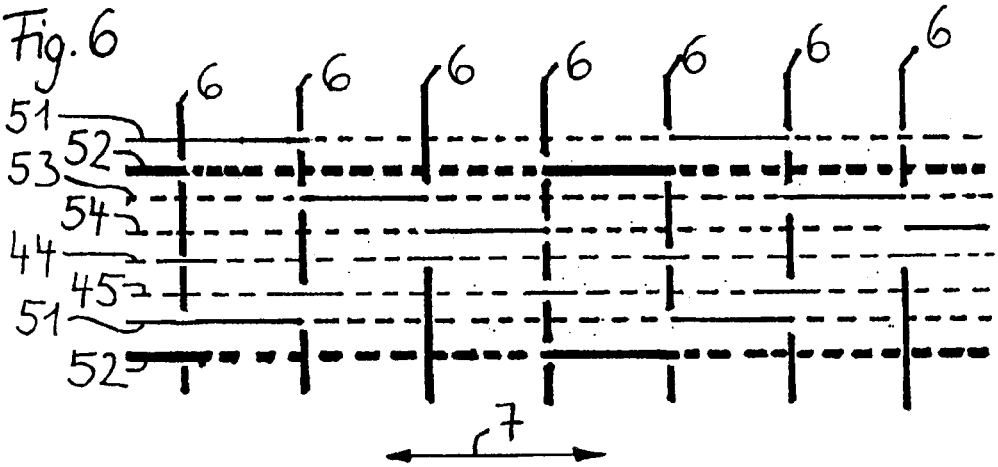
FIG. 6 is a schematic illustration of a plan view onto the upper fabric layer of the belt of FIG. 5, wherein the upper fabric layer forms the paper side.
Figure 7:
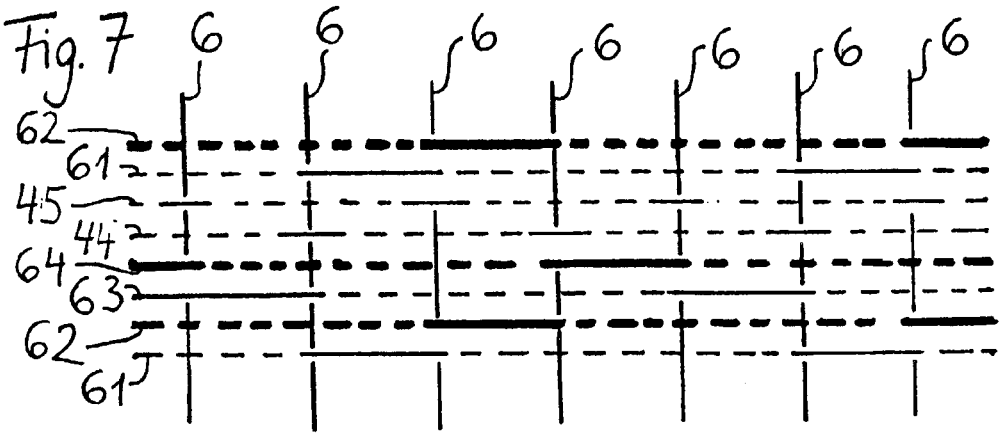
FIG. 7 is a schematic illustration of a plan view onto the lower fabric layer of the belt of FIG. 5.

FIG. 6 shows a schematic illustration of a plan view onto the upper fabric layer, and FIG. 7 a schematic illustration of a plan view onto the lower fabric layer of the same belt section illustrated in FIG. 6. The four warp threads 51, 52, 53 and 54 are arranged adjacent to one another and two binding threads 44 and 45 are arranged adjacent to them. The threads of the lower fabric layer 60, as illustrated in FIG. 7, are woven correspondingly. The warp thread 52 of the upper fabric layer 50 and the warp threads 62 and 64 of the lower fabric layer 60 have a greater diameter than the other warp threads. In this way, drainage channels are formed wherein the upper fabric layer 50 has more drainage channels than the lower fabric layer 60. The drainage channels can also be formed by the thread structure of the warp threads 51 through 54 and 61 through 64. For this purpose, the threads can have, for example, grooves in the longitudinal direction.

Figure 8:
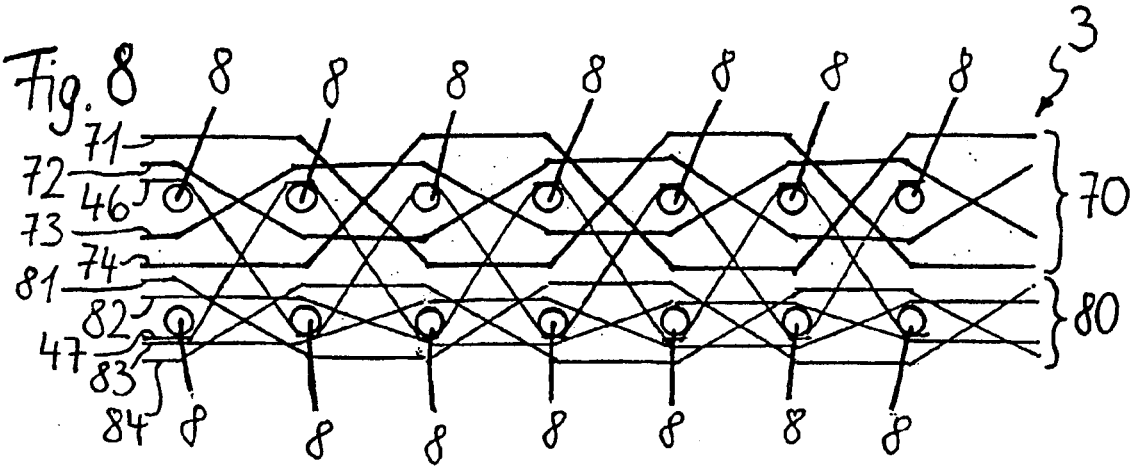
FIG. 8 is a schematic illustration of a third embodiment of a woven belt according to the present invention in longitudinal section.
Figure 9:
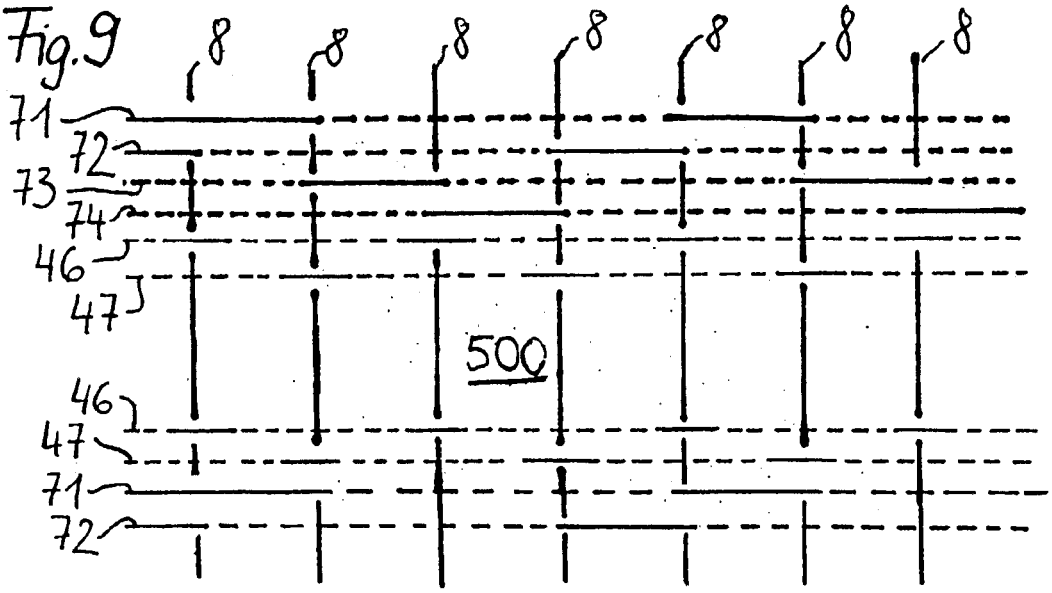
FIG. 9 is a schematic illustration of a plan view of the upper fabric layer of the belt of FIG. 8 forming the paper side.
Figure 10:
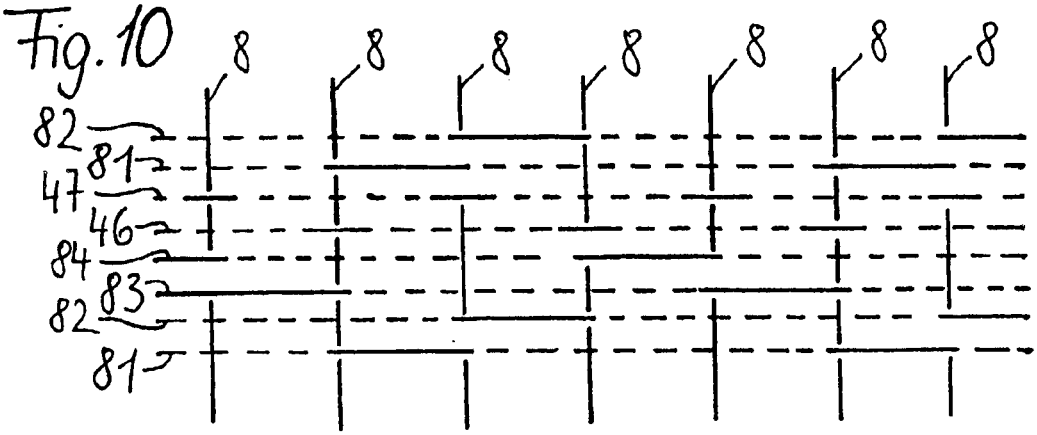
FIG. 10 is a schematic illustration of a plan view onto the lower fabric layer of the belt of FIG. 8.

FIGS. 8, 9, and 10 show a belt 3 comprising an upper fabric layer 70 and a lower fabric layer 80. The warp threads 71 to 74 of the upper fabric layers 70 and the warp threads 81 and 84 of the lower fabric layer 80 extend in accordance with the warp threads 51 to 54 and 61 to 64 in FIG. 5. The upper fabric layer 70 and the lower fabric layer 80 are interwoven with one another by binding threads 46 and 47 wherein the binding threads 46, 47 cross one weft thread 8 of the fabric layers 70 and 80, respectively. FIG. 9 shows a schematic plan view of the belt 3. The warp threads 71 to 74 are woven adjacent to one another; adjacently arranged are the binding threads 46 and 47. The drainage channels 500 are formed by omitting every other warp thread set of the fabric layer 70 so that, from top to bottom as illustrated in FIG. 9, a second arrangement of binding threads 46 and 47 follows the arrangement of the upper binding threads 46 and 47; a repeating set of warp threads 71 to 74 then follows the lower arrangement of binding threads 46, 47. The lower fabric layer 80 illustrated in FIG. 10 in a view onto the bottom side of the belt 3 extends in accordance with the lower fabric layer 60 of the belt 2 illustrated in FIG. 7, wherein the warp threads 81 to 84 of the lower fabric layer 80 can all have the same diameter.

For increasing the temperature resistance and wear resistance of belts 1, 2, 3, thread material having a high temperature resistance, in particular, para aramids or Kevlar®, can be woven into the edge area of the belt in the longitudinal direction 5, 7 of the belt. However, the temperature resistant thread material can also extend across the entire width of the upper fabric layer 10, 50, 70 or the lower fabric layer of 30, 60, 80 or the upper and lower fabric layers. The drainage channels 500 can also be formed as openings in the woven structure. For this purpose, neighboring warp threads of a fabric layer can cross one another, for example.

The thread material can be comprised of 65% polyester and 35% viscose. Other combinations or compositions can also be advantageous.

The thread material can also be a monofilament.

While specific embodiments of the invention have been shown and described in detail to illustrate the inventive principles, it will be understood that the invention may be embodied otherwise without departing from such principles.

What is claimed is:

1. A fabric belt for a corrugated cardboard gluing machine, the fabric belt comprising:

a first fabric layer for receiving tensile forces, the first fabric layer comprised of warp threads and weft threads;

a second fabric layer covering the first fabric layer and comprised of warp threads and weft threads;

wherein the second fabric layer forms an upper paper side of the fabric belt;

wherein the first and second fabric layers are interwoven by binding threads;

wherein the fabric belt has drainage channels penetrating the fabric belt at least partially, wherein the drainage channels remove moisture from the second fabric layer and the upper paper side; and wherein the drainage channels are mechanically woven into the fabric belt and extend from the upper paper side to an underside of the fabric belt.

2. The belt according to claim 1, the drainage channels are openings formed in a woven fabric structure of the fabric belt.

3. The belt according to claim 1, wherein the drainage channels are formed by providing at least one of a different thread thickness and a different thread structure for at least some of the warp threads, the weft threads, and the binding threads.

4. The belt according to claim 1, wherein the drainage channels are formed by creating gaps in a woven fabric structure of the fabric belt by omitting threads in or adding threads to the woven fabric structure.

5. The belt according to claim 1, wherein at least one of the first and second fabric layers comprises individual threads made of a cavity-forming thread material forming cavities after a period of use of the fabric belt, wherein the cavities form the drainage channels.

6. The belt according to claim 5, wherein the thread material has a high starch contents.

7. The belt according to claim 6, wherein the thread material is starch.

8. The belt according to claim 5, wherein the thread material is comprised of hollow fibers.

9. The belt according to claim 5, wherein the individual threads comprised of the cavity-forming material form at least some of the warp threads, the weft threads, and the binding threads.

10. The belt according to claim 9, wherein the individual threads are auxiliary threads.

11. The belt according to claim 1, wherein in the first thread layer the warp threads cross at least two of the weft threads and wherein in the second fabric layer the warp threads extend inwardly and outwardly across at least two of the weft threads, wherein in the first and second fabric layers the warp threads are arranged in repeating sets, respectively, wherein the warp threads within each one of the repeating sets are displaced relative to one another.

12. The belt according to claim 11, wherein the binding threads extend across one of the weft threads, respectively.

13. The belt according to claim 1, wherein the warp threads, the weft threads and the binding threads are plastic threads comprised of a mixture of approximately 65% polyester and approximately 35% viscose.

14. The belt according to claim 1, further comprising a thread material having a high temperature resistance woven into a woven fabric structure of the fabric belt.

15. The belt according to claim 14, wherein the thread material is selected from the group consisting of para aramids and Kevlar®.

16. The belt according to claim 1, further comprising a third fabric layer arranged on a side of the first fabric layer opposite the second fabric layer, wherein the first, second, and third fabric layers are interwoven by the binding threads.

* * * * *